United States Patent [19]

Atkinson

[11] Patent Number: 4,959,927

[45] Date of Patent: Oct. 2, 1990

[54] DOOR DRAFT STOPPER

[76] Inventor: Arthur B. Atkinson, R.D. Box 443 Old Bentley Rd., Hightstown, N.J. 08520

[21] Appl. No.: 401,932

[22] Filed: Sep. 1, 1989

[51] Int. Cl.[5] ..... E06B 7/16

[52] U.S. Cl. ..... 49/476; 49/482

[58] Field of Search ..... 49/475, 476, 478, 481, 49/488, 310, 315, 470, 482, 493; 401/197

[56] References Cited

U.S. PATENT DOCUMENTS

| | | | |
|---|---|---|---|
| 634,491 | 10/1899 | Winter | 49/481 |
| 1,422,569 | 7/1922 | Hammes | 49/481 |
| 1,697,408 | 1/1929 | Thompson | 49/310 |
| 1,705,454 | 3/1929 | Griffiths | 49/475 |
| 1,783,305 | 12/1930 | Olson | 49/482 |
| 1,837,959 | 12/1931 | Gaskin et al. | 49/482 |
| 2,537,296 | 1/1951 | Yeakel | 49/306 |
| 3,179,971 | 4/1965 | Benedetti | 401/197 |
| 3,702,739 | 11/1972 | Rentfrow | 401/197 |
| 4,320,598 | 3/1982 | Rodak et al. | 49/481 |
| 4,765,094 | 8/1988 | Gemmell | 49/475 |

FOREIGN PATENT DOCUMENTS

| | | | |
|---|---|---|---|
| 139006 | 5/1949 | Australia | 49/476 |
| 252798 | 7/1964 | Australia | 49/478 |

*Primary Examiner*—Gary L. Smith
*Assistant Examiner*—Michael J. Milano
*Attorney, Agent, or Firm*—Richard L. Miller

[57] ABSTRACT

A door draft stopper is provided and consists of an elongated hood member installed near bottom edge of a swinging door and a floating roller assembly disposed within open bottom of the hood member for relative free vertical movement therein to seal a draft area between the bottom edge of the door and a sill.

2 Claims, 1 Drawing Sheet

DOOR DRAFT STOPPER

BACKGROUND OF THE INVENTION

The instant invention relates generally to weather stripping and more specifically it relates to a door draft stopper.

Numerous weather stripping have been provided in prior art that are adapted to control drafts beneath the bottom of doors and the sills when the doors are closed. For example, U.S. Pat. Nos. 2,537,296 to Yeakel; 2,555,244 to Pietrushak and 4,320,598 to Rodak et al all are illustrative of such prior art. While these units may be suitable for the particular purpose to which they address, they would not be as suitable for the purpose of the present invention as hereafter described.

SUMMARY OF THE INVENTION

A primary object of the present invention is to provide a door draft stopper that will overcome the shortcomings of the prior art devices.

Another object is to provide a door draft stopper with floating rollers to give a better seal and keep out the draft when the door is closed, while causing less wear to the adjacent floor rug or covering.

An additional object is to provide a door draft stopper that can be made to fit various size widths of doors, and cannot be kicked away.

A further object is to provide a door draft stopper that is simple and easy to install and use.

A still further object is to provide a door draft stopper that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
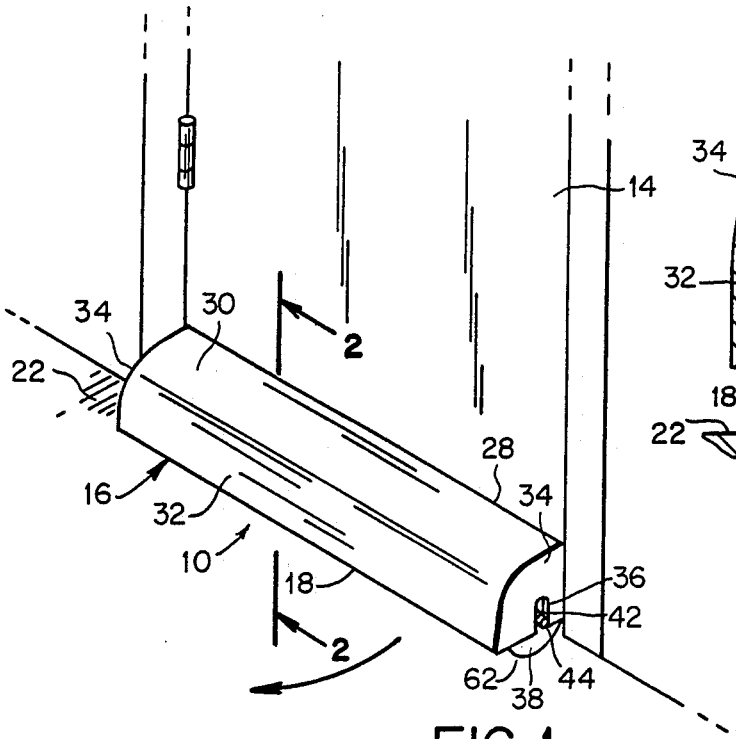
FIG. 1 is a perspective view of the instant invention installed near the bottom edge of a door.
Figure 2:
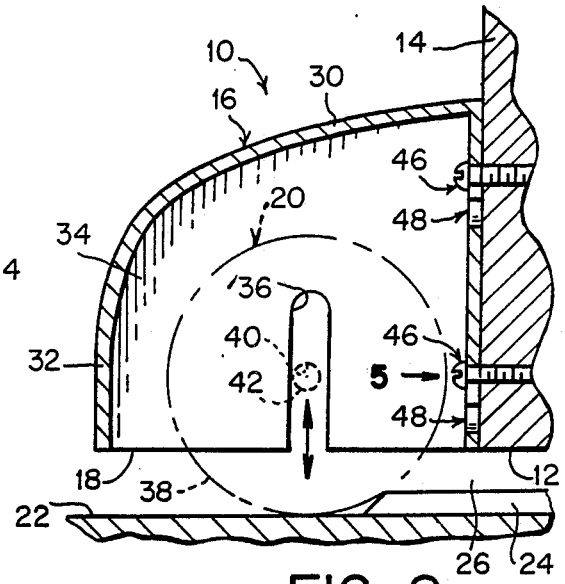
FIG. 2 is an enlarged cross sectional view taken along line 2—2 in FIG. 1 with roller and axle shown in phantom.
Figure 3:
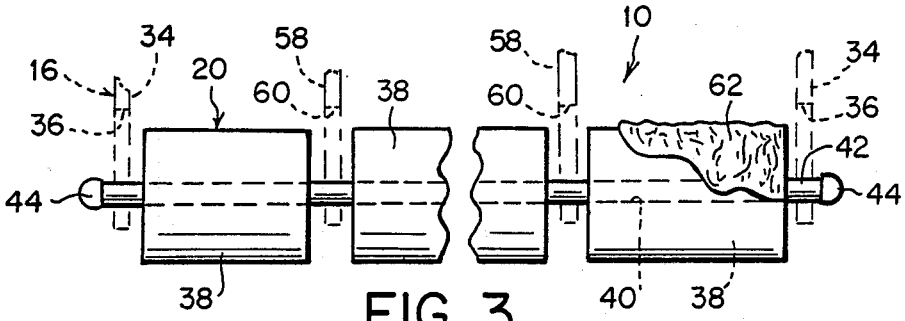
FIG. 3 is a view illustrating the internal construction of a multi-roller assembly.
Figure 5:
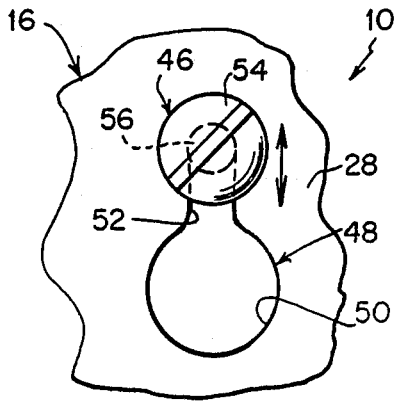
FIG. 5 is an elevational view taken in direction of arrow 5 in FIG. 2 of a portion of the rear wall of the hood member showing an aperture for receiving the head of the fastener when the hood member is installed near the bottom edge of the door.
Figure 4:
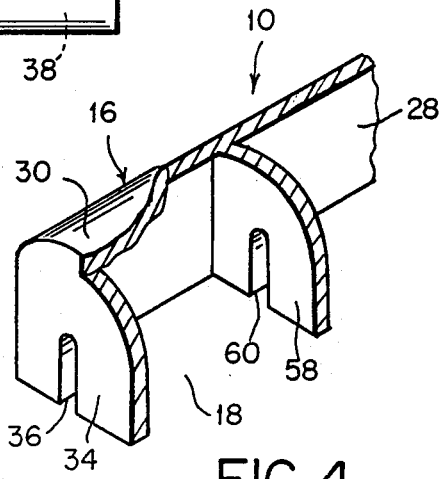
FIG. 4 is a perspective view of a portion of the hood member broken away to show one end wall and one internal wall.

Turning now descriptively to the drawings, in which like reference characters denote like elements throughout the several views, the Figures illustrate a door draft stopper 10 for installation near bottom edge 12 of a swinging door 14. The stopper 10 consists of an elongated hood member 16 having an open bottom 18. A floating roller assembly 20 is disposed within the open bottom 18 of the hood member 16 for relative free vertical movement therein. The hood member 16 is installed near the bottom edge 12 of the door 14 so that the roller assembly 20 will be movable along a floor 22 in contact therewith when the door 14 is opened and closed. When the door 14 is closed the roller assembly 20 will bear against a sill 24 under the bottom edge 12 of the door 14 to seal a draft area 26 between the bottom edge 12 of the door and the sill 24.

The hood member 16 includes a flat rear wall 28 to be placed against the door 14 near the bottom edge 12 thereof. A curved top wall 30 extends to front wall 32 of the hood member 16. A pair of side walls 34 are also provided. Each side wall 34 has an aligned blind-ended vertical slot 36 extending upwardly from the open bottom 18 so that the roller assembly 20 can be disposed therein.

The roller assembly 20 includes at least one roller member 38 having a longitudinal aperture 40 therethrough. A shaft 42 is disposed through the aperture 40 to extend at each distal end through one of the vertical slots 36 is one of the side walls 34 of the hood member 16. A pair of caps 44 are also provided. Each cap 44 is disposed on one distal end of the shaft 42 to hold and guide the shaft 42 when the shaft rides freely up and down within the vertical slots 36.

Spaced apart fasteners 46 are attached to the door 14 near the bottom edge 12 thereof. The rear wall 28 of the hood member 16 has spaced apart mounting holes 48. Each of the holes 48 have an enlarged bottom portion 50 and a narrow top portion 52. The enlarged bottom portion 50 aligns with and receives one head 54 of one fastener 46 while the narrow top portion 52 receives a shank 56 of the respective fastener 46 when the hood member 16 is pushed downwardly so as to secure the hood member to the door 14.

The hood member 16 can also include a plurality of spaced apart internal walls 58. Each internal wall 58 has an aligned vertical slot 60 extending upwardly from the open bottom 18 so that a plurality of roller members 38 on the shaft 42 can be carried therein to compensate for various widths of the door 14.

Each roller member 38 further includes a carpet like covering 62 there about its circumference so as to help seal the draft area 26 between the bottom edge 12 of the door 14 and the sill 24.

Once the door draft stopper 10 is installed on the door 14 the draft area 26 will be sealed. When a person opens and closes the door 14 the roller member 38 will always make contact and roll across the floor 22 by way of the free vertical floating movement within the hood member.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A roller-type door draft stopper for installation near a bottom edge of a swinging door comprising:

(a) an open bottomed, elongated hood member including a flat rear wall to be placed against the door near the bottom edge thereof; a curved top wall extending to a front wall of said hood member; and a pair of side walls and a plurality of spaced apart internal walls, having respectively aligned blind-ended vertical slots extending upwardly from the open bottom;

(b) a floating roller assembly disposed within the open bottom of said hood member for relative free vertical movement therein; and including a plurality of roller members each having a longitudinal aperture therethrough; a shaft disposed through said longitudinal apertures and extending freely through said vertical slots with said roller members separated from each other by said internal walls; and a pair of caps, disposed respectively on distal ends of said shaft to hold and guide said shaft enabling said shaft to rise freely up and down within the vertical slots;

(c) means for installing said hood member near the bottom edge of the door comprising at least two spaced apart fasteners attached to the door near the bottom edge thereof; and said rear wall of said hood member further having at least two spaced apart mounting apertures, each of said holes having an enlarged bottom entry portion for alignment with and receipt of one head of one of said fasteners and a narrow top portion for receiving a shank of said respective fasteners when said hood member is pushed downwardly securing the hood member to the door whereby said roller assembly will be rolled along a floor in contact therewith when the door is opened and closed said roller assembly will bear against a sill under the bottom edge of the door when the door is closed sealing a draft area between the bottom edge of the door and the sill.

2. A door draft stopper as recited in claim 1, wherein each said roller member further includes a carpet like covering there about the circumference so as to help seal the draft area between the bottom edge of the door and the sill.

* * * * *